US006167924B1

(12) United States Patent
Buckley et al.

(10) Patent No.: US 6,167,924 B1
(45) Date of Patent: Jan. 2, 2001

(54) ROTATING BALLOON APPARATUS

(76) Inventors: Gary S. Buckley; Linda G. Buckley, both of P.O. Box 583, Yucaipa, CA (US) 92399

( * ) Notice: Under 35 U.S.C. 154(b), the term of this patent shall be extended for 0 days.

(21) Appl. No.: 09/569,369

(22) Filed: May 11, 2000

(51) Int. Cl.[7] ..... B65B 1/04; B65B 3/04; B67C 3/00

(52) U.S. Cl. ..... 141/313; 141/114; 141/197; 141/250; 141/267; 141/268; 141/383; 141/386; 53/79; 446/220

(58) Field of Search ..... 141/34, 37, 94, 141/114, 192, 197, 250, 267, 268, 279, 311 R, 313, 382, 383, 386, 391; 53/403, 79; 446/220, 226

(56) References Cited

U.S. PATENT DOCUMENTS 3,616,823 * 11/1971 Iacono ..... 141/137
4,088,161 * 5/1978 Ikemoto ..... 141/167
5,067,301 * 11/1991 Shore ..... 53/79
5,370,161 * 12/1994 Shater ..... 141/114

* cited by examiner

*Primary Examiner*—Steven O. Douglas
*Assistant Examiner*—Timothy L. Maust
(74) *Attorney, Agent, or Firm*—Sheldon & Mak

(57) ABSTRACT

A balloon rotation apparatus includes a base; a rotator disk or plate rotatable on the base and having an air passage opening therethrough to a sealingly connectable balloon envelope; a motor drive including a plurality of resiliently tired wheels for supporting and rotating the rotator plate; a duct connected to the base and having a duct inlet for connection to a source of pressure gas, and a duct outlet located proximate rotator plate for feeding the pressure gas through the inlet passage for inflating the balloon and maintaining the inflation while the rotator plate is being rotated. The duct includes a flexible sheet enclosing at least a portion of the base having a ring rigidly supported proximate the rotator plate and having a portion of the sheet of the duct fastened thereto for forming the duct outlet, a plurality of leg supports being rigidly connected to the base and projecting outwardly from the sheet member of the duct. A locating plate is sealingly connectable to the balloon envelope opposite the inlet extremity, and elongate mast structure being engagable with the base for projecting above an upper extremity of the balloon envelope, the locating plate being rotatively and slidably supported on the mast structure, the mast structure having a coupling mounted proximate an upper extremity thereof for connecting a plurality of tethering lines in outwardly projecting relation to the balloon envelope for stabilizing same in alignment with the rotator plate.

22 Claims, 4 Drawing Sheets

ROTATING BALLOON APPARATUS

BACKGROUND

The present invention relates to balloons such as are used in display advertising, and more particularly to blower-inflated balloons that are typically at least several feet in diameter and tethered close to the ground or other supporting structure.

Large balloons are often used for advertising, especially outdoor advertising, to attract attention to a business itself, or a product being sold, being commonly referred to as "advertising inflatables." In one commonly used form, a blower is connected by a flexible duct to a bottom neck inlet of a balloon envelope of thin sheet material, and the balloon is tethered by a plurality of tie-downs. In some cases, the outside of the balloon is brightly colored for attracting the attention of potential customers that will be induced thereby to identify nearby signage or other indicia of products and/or services being advertised. In other cases, the balloon is provided with such indicia, often together with content-neutral bright coloring. These balloons can have various shapes that are usually circularly symmetrical, but can also be simulative of product shapes and/or cartoon characters.

There is a trade-off between the size (and cost) of providing and maintaining the balloon and the effectiveness of the advertizing, the trade-off being complicated by competing needs of attracting attention and conveying information. Similarly, balloons that are merely used for decoration are subject to a corresponding trade-off between size (and cost) and the effectiveness or impact of the decoration.

Also, large balloons that are used outdoors are subject to being blown away or harmfully damaging nearby structures when subjected to high winds.

Thus there is a need for a balloon apparatus that has improved effectiveness for decoration, attention-getting and information display and that is pleasing in appearance, effectively anchored against high winds, inexpensive to provide and easy to erect.

SUMMARY

The present invention meets this need by providing a large inflatable balloon that rotates for more effectively attracting attention and for exposing a particularly large display surface area for a given size of the balloon. In one aspect of the invention, a balloon rotation apparatus includes a base; a rotator plate rotatably located relative to the base on a main axis and having an air passage opening therein; means for sealingly fastening an inlet extremity of a balloon envelope to the rotator plate with the air passage opening in fluid communication with an inflatable cavity of the balloon envelope; a motor drive for rotating the rotator plate relative to the main axis; and means for coupling gas under pressure to the air passage opening for inflating the balloon and maintaining the inflation while the rotator plate is being rotated.

The apparatus can further include an arbor member extending on the main axis, the rotator plate engaging the arbor member and being located thereby. The main axis can be vertical. The motor drive can include a powered drive wheel engaging the rotator plate. The drive wheel can be on a drive axis being inclined relative to the main axis, the drive wheel frictionally contacting a downwardly facing surface of the rotator plate. The drive wheel can be one of a plurality of support wheels being rotatably mounted relative to the base. The support wheels can rotate on respective horizontal support axes that intersect the main axis. Each of the support wheels can have a resilient tire member.

The apparatus can further include a locating plate having means for connecting the balloon envelope opposite the inlet extremity; and a coupling for connecting a plurality of tethering lines in outwardly projecting relation to the balloon envelope for stabilizing same in alignment with the rotator plate. Preferably the locating plate includes respective upper and lower locating plate members and means for sealingly clamping flexible sheet material between the locating plate members. The apparatus can further include an elongate mast structure; and means for connecting the mast structure upwardly projecting from the base proximately concentric with the main axis, the locating plate being rotatively and slidably supported on the mast structure, the coupling being mounted proximate an upper extremity of the mast structure.

Preferably the means for sealingly fastening includes the rotator plate having respective upper and lower rotator plate members, and means for sealingly clamping flexible sheet material between the plate members. The means for sealingly fastening can include a flexible sheet material neck ring sealingly clamped between the rotator plate members and projecting outwardly therefrom, the neck ring being adapted for being sealingly joined to the balloon envelope.

The means for coupling can include a duct connected to the base and having a duct inlet for connection to a source of the pressure gas, and a duct outlet fixably located proximate rotator plate for feeding the pressure gas into the inlet passage. The apparatus can further include a blower unit sealingly connected to the duct inlet for providing the pressure gas as pressurized air. The duct can include a flexible sheet member enclosing at least a portion of the base, the base having a ring member rigidly supported proximate the rotator plate and having a portion of the sheet member of the duct fastened thereto for forming the duct outlet.

The apparatus can have a plurality of leg supports rigidly connected to the base and projecting outwardly from the sheet member of the duct. Each of the leg supports can be formed having a leg attachment, the apparatus further including a plurality of leg members for removably engaging a respective leg attachment, and means for rigidly holding the leg members in outwardly projecting relation to the leg supports for stabilizing the base. Preferably each of the leg members is adapted for connecting an anchor line to external structure for anchoring the base in a fixed location.

The balloon rotator apparatus can be in combination with the balloon envelope.

DRAWINGS

These and other features, aspects, and advantages of the present invention will become better understood with reference to the following description, appended claims, and accompanying drawings, where:

DESCRIPTION

Figure 3:
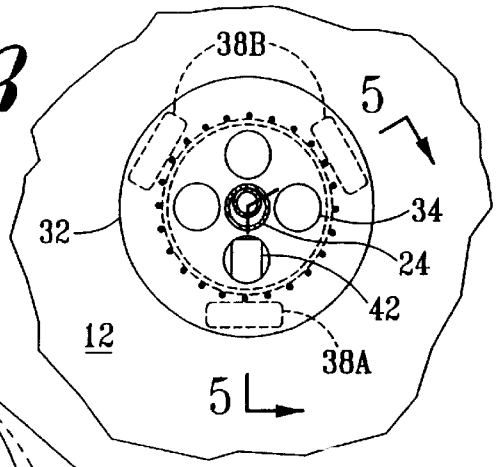
FIG. 3 is a sectional view of a portion of the apparatus of FIG. 1 on line 3—3 therein.

The present invention is directed to a rotating balloon apparatus that is particularly effective for attracting attention and displaying advertising content. With reference to FIGS. 1–5 of the drawings, a rotating display balloon apparatus 10 includes an inflated balloon envelope 12 rotatably supported by a base 14 having an air supply duct 16 fluid-connected to a blower 18 for pressurizing and maintaining inflation of the balloon. In an exemplary configuration, the balloon envelope includes a spherical main portion 12A and a neck portion 12B of reduced diameter. A drive mechanism 20 is supported by the base for turning the inflated envelope 12 as described below. As shown in FIGS. 2–5, the base 14 includes a frame 22 having a plate arbor 24 upwardly projecting on a main axis 25, and a ring member 26 for supporting an extremity of the duct 16 to form a duct outlet 28 approximately concentric with the arbor 24, at least a portion of the duct 16 being formed of a flexible sheet member 30 that preferably encloses at least a portion of the frame 22 as further described below.

Figure 4:
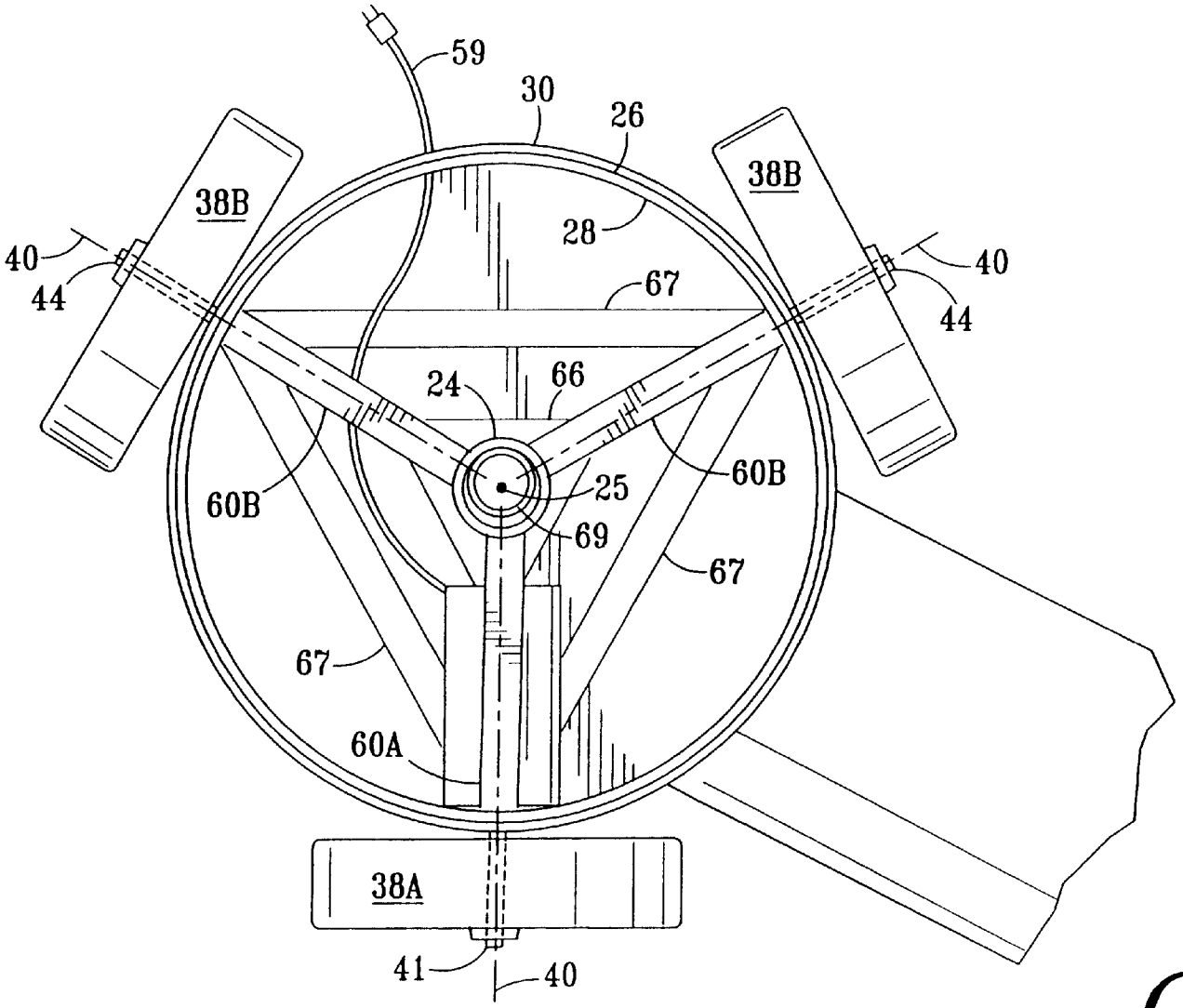
FIG. 4 is a plan view of a portion of the apparatus of FIG. 1 on line 4—4 of FIG. 2.
Figure 5:
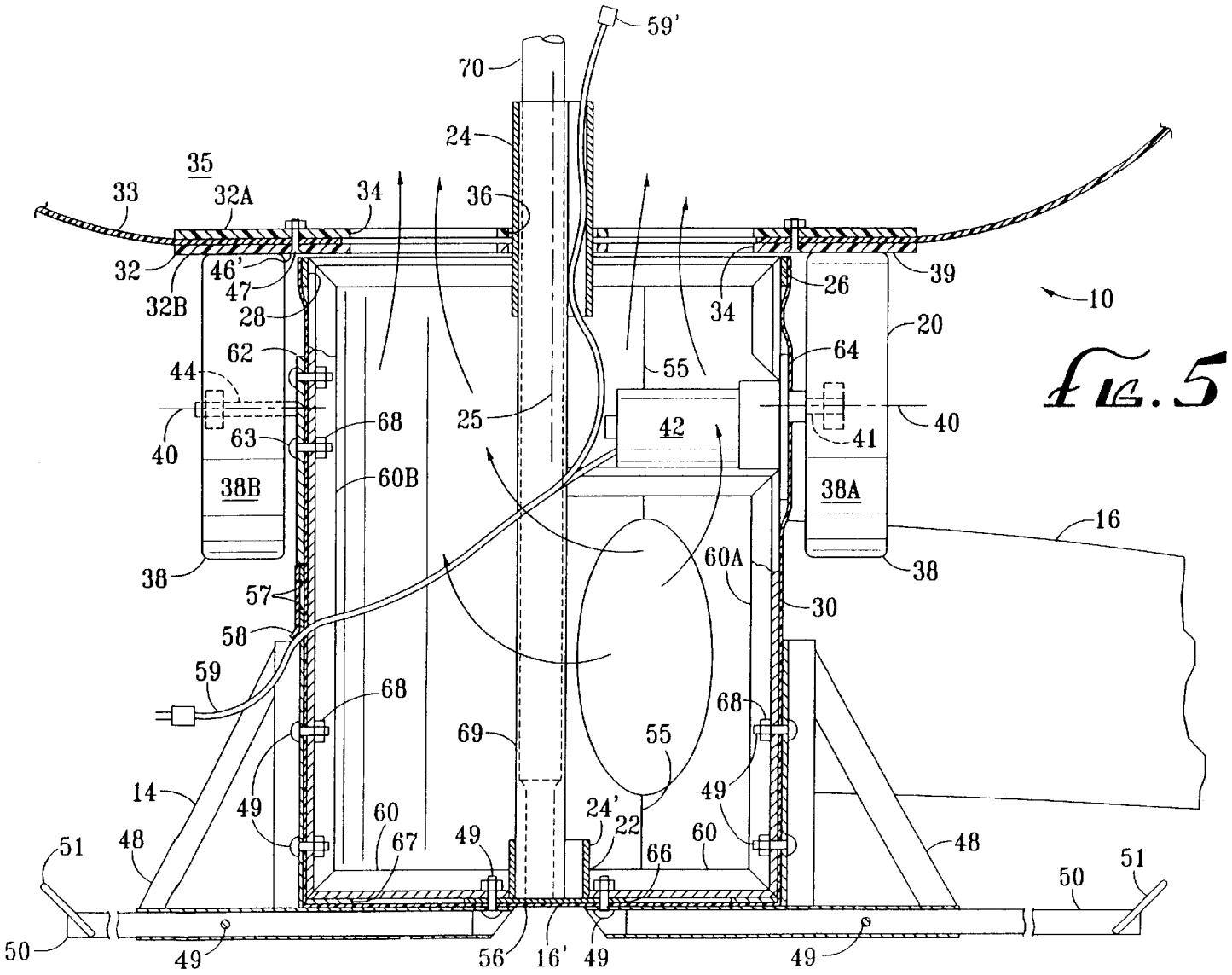
FIG. 5 is a sectional view of a portion of the apparatus of FIG. 1 on line 5—5 of FIG. 3.

The drive mechanism 20 includes a rotator disk or plate 32 that is sealingly connected to an inlet extremity 33 of the balloon envelope 12, the plate 32 having one or a plurality of inlet passage openings 34 therethrough for feeding pressure air from the duct outlet 28 into a main cavity 35 of the balloon envelope, thereby inflating the envelope to form a semi-rigid structure. The rotator plate 32 also has a central opening 36 that slidingly engages the plate arbor 24 for locating the plate concentric with the main axis 25. Optionally, a flexible sheet material inlet ring 37 is sealingly joined to the rotator plate 32 as described below for facilitating the connection to the inlet extremity 33 of the balloon envelope 12. The balloon envelope 12 is supported by the rotator plate 32 on a plurality of support wheels 38, including a drive wheel 38A and a pair of idler wheels 38B, that rollingly contact a downwardly facing rim surface 39 of the rotator plate 32. As shown in FIGS. 4 and 5, the support wheels 38 rotate on respective horizontal support axes 40 that intersect the main axis 25, the drive wheel 38A being fastened to an output shaft 41 of a drive motor 42 that is rigidly fastened to the frame 22.

The idler wheels 38B are rotatably mounted on respective axle shafts 44 that are also rigidly fastened to the frame 22, the drive motor powering rotation of the inflated balloon envelope 12 by frictional contact of the drive wheel 38A against the rim surface 39 of the rotator plate 32, as enabled by the drive wheel 38A supporting a significant portion of the weight of the balloon envelope 12 (and the rotator plate 32). A motor suitable for use as the drive motor 42 is available as Dayton gear motor (14 RPM, 1/60 HP), Stock No. 4Z062, from Grainger Co. at numerous locations including Northridge, Calif. Another suitable motor (28 RPM, 1/25 HP) is similarly available under Stock No. 4Z063.

A preferred configuration of the rotator plate 32 is formed by a nearly identical pair of plate members, designated upper plate member 32A and lower plate member 32B as shown in FIG. 5. The plate members are each formed with counterparts of the inlet passage openings 34 and the central opening 36, as well as a plurality of fastener openings 46, the fastener openings of the lower plate member 32B being preferably countersunk as indicated at 46' for receiving respective threaded fasteners 47 that are substantially flush with the downwardly facing rim surface 39 for facilitating a close spacing of the rim surface 39 above the duct outlet 28 to achieve a desired degree of sealing with not more than incidental rubbing contact between the duct outlet 28 and the rotator plate 32. The fasteners 47 serve to sealingly clamp the inlet ring 37 of the balloon envelope 12 between the plate members 32A and 32B. A preferred material for the plate members 32A and 32B is Lexan® polycarbonate plastic, 0.19 inch thick, a suitable size being 23.75 inches in diameter. The inlet openings 34 are suitably four in number, having a diameter of approximately 6 inches for a total inlet area that is not less than the outlet area of the blower 18. The optional inlet ring 37, which can be cut to an outside diameter of approximately 6 feet from 9 oz. vinyl coated nylon material, extends sufficiently inwardly between the plate members 32A and 32B to include counterparts of the fastener openings 46 whereby the ring 37 is secured by engagement with the fasteners 47 in addition to the clamping of the plate members. The ring 37 can further extend inwardly, if desired, to include counterparts of the inlet openings 34 and the central opening 36. Also, the inlet ring 37 can have a non-circular outline, particularly when the balloon envelope 12 is irregularly shaped. The inlet ring is sewn into the balloon envelope 12 around the inlet extremity 33 in a conventional manner. Alternatively, the inlet extremity 33 itself extends between the rotator plates 32A and 32B in like manner.

Figure 1:
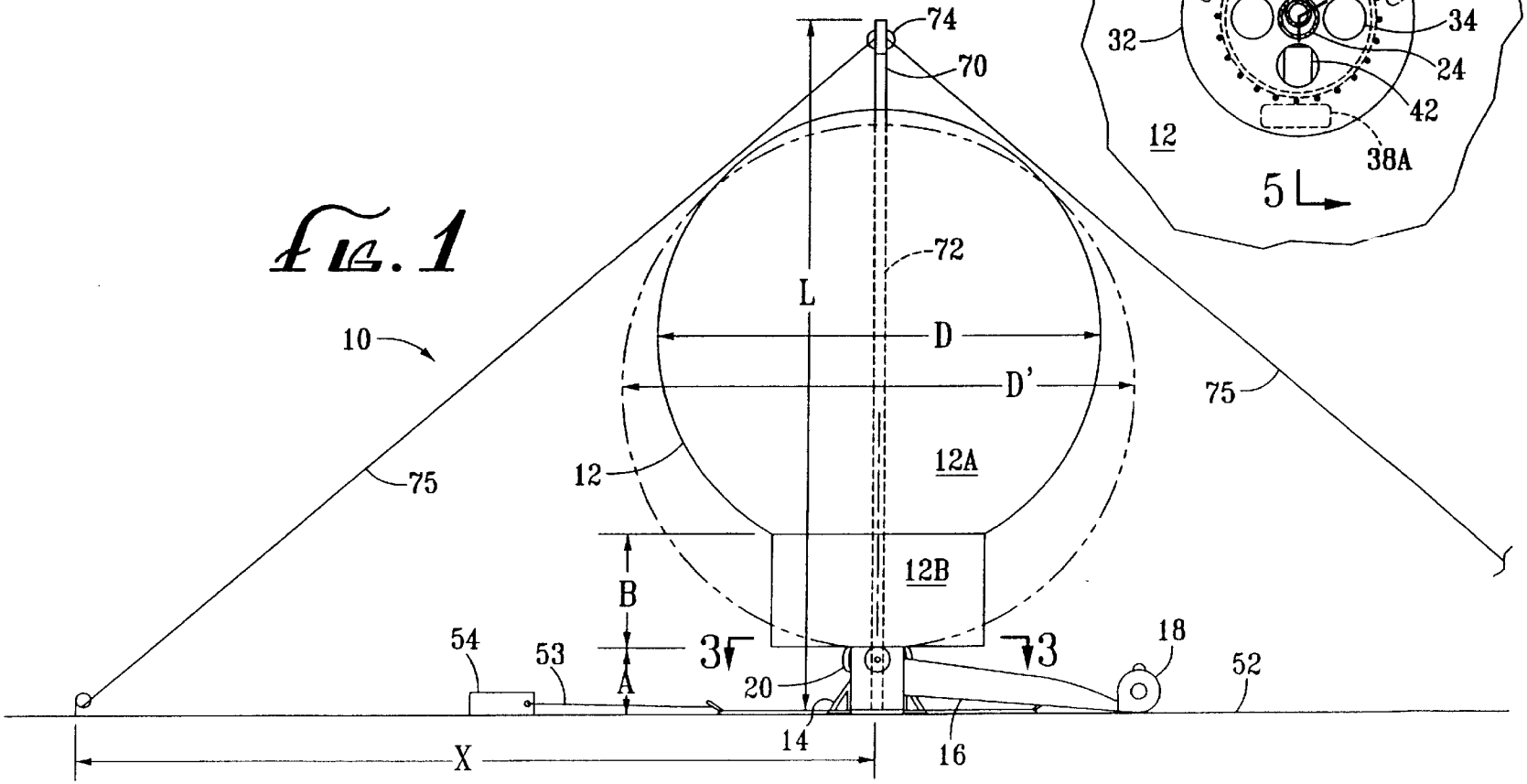
FIG. 1 is an elevational view of a rotating balloon apparatus according to the present invention.

A preferred configuration of the base 14 has the frame 22 entirely enclosed by a bag shaped outlet portion 16' of the duct 16. A plurality (typically three) leg holders 48 are fastened to the frame 22 by respective pluralities of leg fasteners 49, portions of the outlet portion 16' being clamped between the frame 22 and the leg holders 48. The leg holders are adapted for telescopically receiving respective stabilizer legs 50 that form outwardly projecting support extremities of the base 14. Each of the legs 50 has a tie-down loop 51 attached at the free end thereof, the legs 50 being anchored to the respective holder by counterparts of the leg fasteners 49. The legs 50 can be formed of suitable lengths of 1 inch square steel tubing, mating portions of the leg holders 48 being formed of 1.25 inch square tubing having a wall thickness of 0.09 inch. Thus the stabilizer legs 50 serve to robustly support the base 14 on a supporting surface 52 while maintaining the main axis 25 vertically oriented (particularly during subsequent further assembly of the device), as well as to provide connection points for ground-level tether lines 53 that can be connected to nearby stationary structures 54 as shown in FIG. 1. The tie-down loops 51 are also adapted for receiving anchoring stakes (not shown) that can be used when the supporting surface 52 is the ground.

Figure 2:
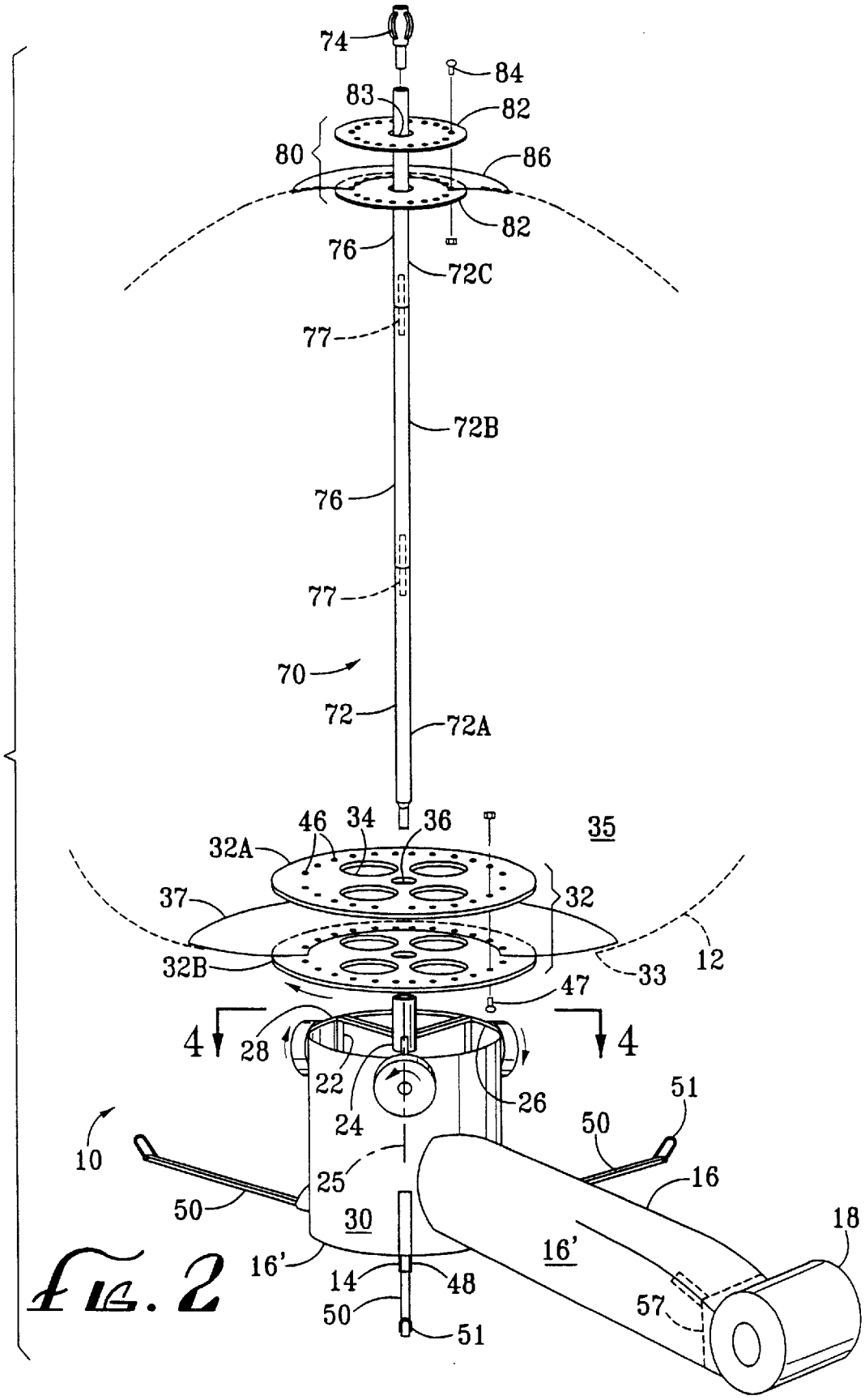
FIG. 2 is a perspective exploded view showing assembleable components of the apparatus of FIG. 1.

The outlet portion 16' of the duct 16 includes a generally rectangular piece of the sheet member 30 having semi-circular cutouts at opposite ends, and a disk-shaped floor element 56, the perimeter of the floor element being sewn along one side edge of the sheet member 30, the opposite ends of the sheet member being similarly sewn together except as interrupted by the semi-circular cutouts as indicated at 55 in FIG. 5. The opposite side edge of the sheet member 30 is fastened to the ring member 26 of the frame 22 in any suitable manner, such as by a spaced plurality of rivets, with an upper marginal extremity of the sheet member 30 preferably projecting slightly above the ring 26 for permitting sliding contact with the rotator plate 32 with the frame 22 being spaced below the plate 32. A tube portion 16" of the duct 16 is formed of a rectangular piece of flexible material having opposite side edges sewn together and one end being sewn along the semi-circular cutouts of the outlet portion sheet member 30. The opposite end of the tube portion 16", and the outlet of the blower 18 are provided with mating strips of a hook-loop fastener 57 as shown in FIG. 2 for completing a sealed connection between the duct 16 and the blower 18, with adjustment to the size of the blower outlet being facilitated by the seam joining the opposite side edges being foreshortened approximately 9 inches from the blower end, and additional hook-loop fastener strips 57 being applied to form an adjustable closure. Suitable devices for use as the blower 18 are commercially available from a variety of sources in sizes ranging from 0.25 HP to 1 HP, being also used for drying rooms and carpets. As shown in FIG. 5, the outlet portion 16' is provided with an openable flap 58 having counterparts of the hook-loop fasteners 57 for passing a power cord 59 to the motor 42 and to an outlet 59' for feeding lighting fixture(s) (not shown) that can be supported within the main cavity 35 of the balloon envelope 12.

The frame 22 is configured having three generally C-shaped frame legs 60, including a motor leg 60A and a pair of wheel legs 60B, approximately equally spaced about the main axis 25, upper inside extremities of the legs 60 being welded to the plate arbor 24, lower inside extremities of the legs 60 being welded to a shorter length counterpart of the plate arbor, designated frame arbor 24'. Each axle shaft 44 is welded to a rectangular axle plate 62, that is in turn fastened to a corresponding wheel leg 60B by a pair of plate fasteners 63, the sheet member 30 of the duct outlet portion 16' being clamped between the plates 62 and the wheel legs 60B. A motor plate 64 is permanently incorporated by being welded into the motor leg 60A for mounting the drive motor 42. A gusset plate 66 is welded to the undersides of the frame arbor 24' and the frame legs 60, and respective brace members 67 are welded between lower outside extremities of adjacent ones of the frame legs 60, the ring member 26 being welded proximate outside upper extremities of the frame legs 60 as shown in FIG. 4. The leg fasteners 49 and the plate fasteners 63 threadingly engage respective machine nuts 68 as shown in FIG. 5. It will be understood that suitable nut plates can be attached to the frame 22 at appropriate locations for use in place of the nuts 68.

A tubular pole socket 69 extends through the arbors 24 and 24' for receiving a mast unit 70, the socket 69 being welded to inside wall portions thereof opposite the motor leg 60A so as to create a passage for the power cord 59 as shown in FIG. 5. Also, a portion of the motor leg 60A extends under the motor 42, being welded to the pole socket 69 for augmenting support of the motor. The arbors 24 and 24' can be formed of suitable lengths of 2.5 inch outside diameter steel tubing, the pole socket 69 being formed of 1.88 inch outside diameter steel tubing, each piece having a wall thickness of 0.065 inch. The frame legs 60, the brace members 67, and upper portions of the leg holders 48 can be formed of suitable lengths of 1 inch steel angle having a flange thickness of 0.13 inch. Suitable wheels for use as the support wheels 38 and having pneumatic tires of approximately 10 inches in diameter are available from a variety of sources, the drive wheel 38A being provided with a suitable hub for rigid mounting on the output shaft 41, the idler wheels 38B having antifriction bearings for free rotation on the axle shafts 44.

The mast unit 70 includes a tie-down pole 72 of length L that projects upwardly from the pole socket 69, being supported by the socket 69 and the gusset plate 66. The pole 72 also projects through an upper extremity of the balloon envelope 12, having a tie-down coupling 74 at the top for connecting a plurality of tie down lines 75, each of the lines 75 being anchored in a suitable manner at a distance X from the main axis 25 as shown in FIG. 1. The tie-down lines 75 can be formed of 1-inch wide nylon straps having suitable clip and adjustable clamp terminations, having a pull rating of 1,900 lbs. In the exemplary configuration of the balloon envelope 12, the main portion 12A has a diameter D and the neck portion 12B has a height B, the rotator plate 32 being at a distance A of approximately 2 feet above the supporting surface 52. As further shown in FIG. 1, when the length L is 21 feet and the distance X is 25 feet, the tie-down lines 75 clear the envelope 12 when the diameter D is not more than 14 feet and the neck height B is not more than about 2 feet. Equivalently, the tie-down lines 75 clear a spherical diameter D' of not more than 16 feet above the rotator plate 32 as indicated by broken lines in FIG. 1, the diameter D' corresponding to a spherical balloon envelope not having the neck portion 12B.

Although the pole 72 can be provided in one piece, it is contemplated that it be segmented as shown in FIG. 2. In an exemplary configuration, the pole includes a base segment 72A, an extension segment 72B, and a top segment 72C, at least the segments 72B and 72C having a main portion 76 and an extension portion 77 of reduced diameter for telescopic assembly of the segments. As further shown in FIG. 2, the base segment 72A has a lower extremity thereof swaged to a reduced diameter for facilitating insertion into the pole socket 69. The pole 72 is commercially available in a single 21 foot length of 1.63 inch outside diameter tubing having a wall thickness of approximately 0.063 inch and being swaged to a reduced diameter at one end for telescopic assembly. The segmented configuration shown in FIG. 2 can be provided by cutting the base segment 72A to a length of 8 feet, the remainder of the 21' length being cut in half to form the main portions 76 of the segments 72B and 72C. Three-foot lengths of smaller pipe are then inserted approximately 18 inches into the main portions 76 and welded on opposite walls thereof to provide the extension segments 77 projecting approximately 18 inches therefrom. In this manner, the extension segments 77 can be provided having greater wall thickness than the base segment 72A and the main portions 76 of the extension and top segments 72B and 72C, thereby to provide enhanced resistance to lateral deflection of the pole 72. Conveniently, the pole segments 72A, 72B, and 72C, made as described above, each have an overall length of 8 feet for facilitating shipping.

A counterpart of the rotator plate 32, designated top plate 80, slidingly engages the pole 72 for stabilizing an upper extremity of the balloon envelope 12. The top plate 80 includes a pair of plate members 82 having a central opening 83 to provide a free running fit on the pole 72, each of the plate members having counterparts of the fastener openings 46, but not the inlet passage openings (34). Accordingly, the plate 80 rises up on the pole sections 72A, 72B, and 72C when the balloon envelope 12 is inflated for rotationally laterally supporting the envelope 12 concentrically with the pole 72.

A principal feature of the present invention is that the balloon envelope 12 can have an advertising message that extends over the full circumference, rather than being confined to one side. Also, whatever pattern is displayed is made dramatically more effective by the rotation imparted by the mechanism 20. Advantageously, the apparatus 10 can be configured to represent a figure, such as a world globe or a toy top, which is expected to be rotating. The additional advertising effectiveness is believed to justify significantly enhanced rental revenue and/or product sales.

Another advantageous feature of the present invention is that the mast unit can be erected and tied down before inflation of the balloon envelope 12, for added safety and ease of erection in windy conditions. Further, when high winds are expected, the motor 32 and the blower 18 can be deactivated for collapsing the balloon envelope with the apparatus 10 remaining secured in place by the tether lines 53 and the tie-down lines 75.

Although the present invention has been described in considerable detail with reference to certain preferred versions thereof, other versions are possible. For example, the apparatus 10 can be scaled up or down to different sizes as desired. The base 14 can be provided with longer and thicker counterparts of the stabilizer legs 50 so that the tie-down lines 75 can be omitted when the apparatus 10 will not be subjected to high winds. For indoor applications, the mast unit 70 can also be omitted, a suitable ring being installed on the plate arbor 24 for retaining the rotator ring 32 in alignment. Alternatively, the top plate 80 can be rotatably mounted on a spindle having a plurality of radiating arm attachments for the tie-down lines, the mast unit 70 being omitted. The motor 42 can be operated with a timer whereby the rotator plate 32 stops and reversed direction at intervals. Alternatively, the balloon envelope can be configured for imparting rotation by wind action. Also, the balloon envelope 12 can be sealed and pressurized, the duct 16 and the blower 18 being omitted. Moreover, a plurality of helium-filled balloons can be substituted for or added to the balloon envelope 12. When used without the envelope 12, individual balloons can be anchored at the rotator fasteners 47 on the plate 32. Therefore, the spirit and scope of the appended claims should not necessarily be limited to the description of the preferred versions contained herein.

What is claimed is:

1. A balloon rotation apparatus comprising:

(a) a base;

(b) a rotator plate rotatably located relative to the base on a main axis and having an air passage opening therein;

(c) means for sealingly fastening an inlet extremity of a balloon envelope to the rotator plate with the air passage opening in fluid communication with an inflatable cavity of the balloon envelope;

(d) a motor drive for rotating the rotator plate relative to the main axis; and (e) means for coupling gas under pressure to the air passage opening for inflating the balloon and maintaining the inflation while the rotator plate is being rotated.

2. The apparatus of claim 1, further comprising an arbor member extending on the main axis, the rotator plate engaging the arbor member and being located thereby.

3. The apparatus of claim 1, in combination with the balloon envelope.

4. The apparatus of claim 1, wherein the means for sealingly fastening comprises the rotator plate including respective upper and lower rotator plate members, and means for sealingly clamping fabric between the plate members.

5. The apparatus of claim 4, wherein the means for sealingly fastening comprises a flexible sheet neck ring sealingly clamped between the rotator plate members and projecting outwardly therefrom, the neck ring being adapted for being sealingly joined to the balloon envelope.

6. The apparatus of claim 1, wherein the means for coupling comprises a duct connected to the base and having a duct inlet for connection to a source of the pressure gas, and a duct outlet fixably located proximate the rotator plate for feeding the pressure gas into the inlet passage.

7. The apparatus of claim 6, further comprising a blower unit sealingly connected to the duct inlet for providing the pressure gas as pressurized air.

8. The apparatus of claim 6, wherein the duct comprises a flexible sheet member enclosing at least a portion of the base, the base having a ring member rigidly supported proximate the rotator plate and having a portion of the sheet member of the duct fastened thereto for forming the duct outlet.

9. The apparatus of claim 8, having a plurality of leg supports rigidly connected to the base and projecting outwardly from the sheet member of the duct.

10. The apparatus of claim 9, wherein each of the leg supports is formed having a leg attachment, the apparatus further comprising a plurality of leg members for removably engaging a respective leg attachment, and means for rigidly holding the leg members in outwardly projecting relation to the leg supports for stabilizing the base.

11. The apparatus of claim 10, wherein each of the leg members is adapted for connecting an anchor line to external structure for anchoring the base in a fixed location.

12. The apparatus of claim 1, wherein the means for sealingly fastening comprises a flexible sheet neck ring sealingly connected to the rotator plate and projecting outwardly therefrom, the neck ring being adapted for being sealingly joined to the balloon envelope.

13. The apparatus of claim 2, wherein the main axis is vertical.

14. The apparatus of claim 13, further comprising:

(a) a locating plate having means for connecting the balloon envelope opposite the inlet extremity; and (b) a coupling for connecting a plurality of tethering lines in outwardly projecting relation to the balloon envelope for stabilizing same in alignment with the rotator plate.

15. The apparatus of claim 14, wherein the locating plate comprises respective upper and lower locating plate members and means for sealingly clamping flexible sheet material between the locating plate members.

16. The apparatus of claim 14, further comprising:

(a) an elongate mast structure;

(b) means for connecting the mast structure upwardly projecting from the base proximately concentric with the main axis, the locating plate being rotatively and slidably supported on the mast structure, the coupling being mounted proximate an upper extremity of the mast structure.

17. The apparatus of claim 13, wherein the motor drive comprises a powered drive wheel engaging the rotator plate.

18. The apparatus of claim 17, wherein the drive wheel is on a drive axis being inclined relative to the main axis, the drive wheel frictionally contacting a downwardly facing surface of the rotator plate.

19. The apparatus of claim 17, wherein the drive wheel is one of a plurality of support wheels being rotatably mounted relative to the base.

20. The apparatus of claim 19, wherein the support wheels rotate on respective horizontal support axes, the support axes intersecting the main axis.

21. The apparatus of claim 19, wherein each of the support wheels comprises a resilient tire member.

22. A balloon rotation apparatus comprising:

(a) a base;

(b) a rotator plate rotatably located relative to the base on a vertical main axis and having an air passage opening therein, an arbor member extending on the main axis, the rotator plate engaging the arbor member and being located thereby, the rotator plate being sealingly connectable to an inlet extremity of a balloon envelope with the air passage opening in fluid communication with an inflatable cavity of the balloon envelope;

(c) a motor drive comprising a plurality of powered support wheels comprising resilient tire members for rotating the rotator plate relative to the main axis, the support wheels rotating on respective horizontal support axes intersecting the main axis, the support wheels frictionally contacting a downwardly facing surface of the rotator plate;

(d) a duct connected to the base and having a duct inlet for connection to a source of gas under pressure, and a duct outlet fixably located proximate rotator plate for feeding the pressure gas into the inlet passage for coupling the pressure gas to the air passage opening for inflating the balloon and maintaining the inflation while the rotator plate is being rotated, the duct comprising a flexible sheet member enclosing at least a portion of the base, the base having a ring member rigidly supported proximate the rotator plate and having a portion of the sheet member of the duct fastened thereto for forming the duct outlet, a plurality of leg supports being rigidly connected to the base and projecting outwardly from the sheet member of the duct;

(e) a locating plate sealingly connectable to the balloon envelope opposite the inlet extremity; and (f) an elongate mast structure engagable with the base proximately concentric with the main axis for projecting above an upper extremity of the balloon envelope, the locating plate being rotatively and slidably supported on the mast structure, the mast structure having a coupling mounted proximate an upper extremity thereof for connecting a plurality of tethering lines in outwardly projecting relation to the balloon envelope for stabilizing same in alignment with the rotator plate.

* * * * *